United States Patent [19]

Oglesby

[11] 3,987,771

[45] Oct. 26, 1976

[54] FUEL AND AIR INJECTION DEVICE

[75] Inventor: Cecil David Oglesby, Manchester, Mo.

[73] Assignee: Borg-Warner Corporation, Chicago, Ill.

[22] Filed: Aug. 1, 1975

[21] Appl. No.: 601,693

[52] U.S. Cl. ..... 123/119 R; 123/32 JV; 123/139 AW; 123/141; 239/416.4; 239/425.5; 239/414; 123/DIG. 10

[51] Int. Cl.[2] ..... F02M 7/00

[58] Field of Search. 123/119 R, 139 AW, DIG. 10, 123/32 AE, 32 EA, 32 JV, 141, 119 D, 124 R; 239/416.4, 425.5, 425, 414, 413, 411, 410, 584

[56] References Cited

UNITED STATES PATENTS

| | | | |
|---|---|---|---|
| 1,599,578 | 9/1926 | Maze | 239/425 |
| 1,611,513 | 12/1926 | Cook et al. | 239/414 |
| 2,494,243 | 1/1950 | Houlis | 239/414 |
| 2,958,471 | 11/1960 | Zippel | 239/416.4 |
| 3,771,505 | 11/1973 | Taplin | 123/DIG. 10 |
| 3,823,699 | 7/1974 | Adair | 123/119 DB |
| 3,938,486 | 2/1976 | Oglesby | 123/DIG. 10 |

FOREIGN PATENTS OR APPLICATIONS

| | | | |
|---|---|---|---|
| 543,863 | 6/1922 | France | 239/416.4 |
| 557,608 | 2/1957 | Italy | 239/416.4 |

*Primary Examiner*—Wendell E. Burns
*Attorney, Agent, or Firm*—Robert L. Zieg

[57] ABSTRACT

A fuel metering device for providing a controlled flow of fuel from a fuel outlet port comprising a body portion, having a fuel valve therein adapted to intermittently admit fuel to a fuel chamber. The fuel chamber partly defines a fuel flow path to the fuel port and a fuel dispersing element is provided in the chamber having a conical dividing surface disposed in the fuel path on the upstream side of the fuel port. The fuel dispersing element includes internal air passages extending through same, the air passage means emitting air in the fuel port centrally of the fuel flow path at the fuel outlet port.

4 Claims, 4 Drawing Figures

FUEL AND AIR INJECTION DEVICE

SUMMARY OF THE INVENTION

Various schemes have been developed for providing fuel in a finely dispersed state mixed with air for use in combustion chambers. Normally such devices require highly pressurized fuel systems. Also it has been found that control over the metering of such metering systems is difficult and not adaptable to pressure pulse control systems.

The present invention over comes these problems by providing a dividing element in a fuel path which has a conical surface in the fuel path to divide and disperse the fuel. Central of the dispersed fuel which comprises a change in a relative annular shape is a tubular air outlet. The fuel charge and air outlet open into a vacuum area such as the intake manifold of an internal combustion engine such that the quick drop in pressure is adapted to aid in tearing the fuel into fine particles.

In addition, a diaphragm is provided for actuating a fuel valve to open the fuel path and at the same time for opening the interior of the dividing element to atmosphere whereby pressure pulses acting against said diaphragm will provide a precise metering function since variation of the frequency or the duration of the pressure pulses will directly vary the amount of fuel metered.

Figure 1:
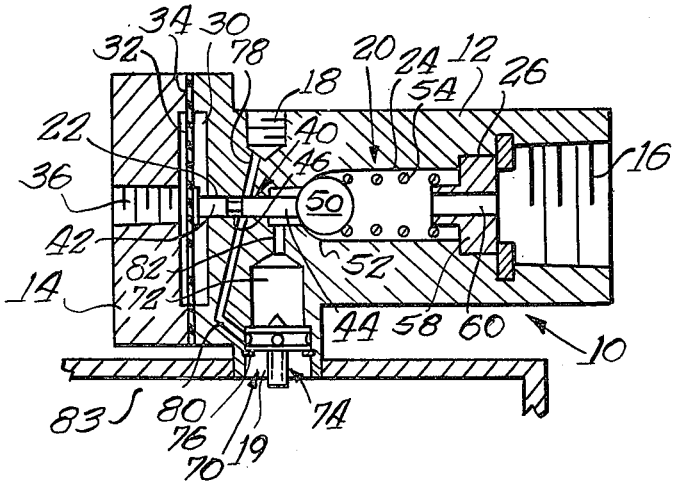
FIG. 1 is a sectional view of an injection valve embodying the principles of the invention.

Referring to the drawing there is shown in FIG. 1 an improved fuel and air injection valve mechanism 10 comprising a valve body 12 having an end member 14 thereon. The body 12 has an inlet port 16 for fuel; an atmospheric port 18; a fuel outlet port 19; and a central axial bore 20 therethrough having a small diameter portion 22, a larger diameter portion 24 and an enlarged diameter portion 26. The diameter portion 26 opens into the threaded port 16 for admission of fuel. In the end of the valve body 12 there is formed a recess 30. The end member 14 has a matching recess 32 which together with recess 34 forms a chamber. The chamber defined by recesses 32 and 30 is divided by a flexible diaphragm member 34. A pressure port 36 is provided centrally, by way of example, of the end member 14 which connects with the recess 32. It will be apparent that port 36 may be other than centrally located as long as it is in communication with recess 32.

Slidable within the bore portion 22 is a valve spool 40 having lands 42 and 44 thereon separated by a groove portion 46. The valve spool 40 is in contact with the flexible diaphragm 34 adjacent the land 42 and is adapted to move with the flexing of the diaphragm 34. On the end of the valve spool 40 adjacent land 44, mounted in the bore portion 24, is a check ball 50 adapted to be received in a valve seat 52. A spring 54 engages the ball 50 and urges it into engagement with seat 52. An orifice plug 58 is provided mounted within the enlarged bore portion 26 which has an orifice passage 60 therethrough communicating with port 16 and with the interior of bore portion 24. The spool 40, ball 50 and seat 52 generally comprise a fuel valve means as will be described.

Provided within the valve body 12 is an improved air-fuel mixing valve 70. The valve 70 includes a fuel chamber or bore 72 extending at generally right angles to the axial bore 20. Received within the chamber 72 and partly disposed within fuel outlet port 19 is a divider valve member or element 74 which is retained within the chamber 72 by retainer ring 76. An atmospheric passage 78 is provided, communicating atmospheric port 18 with the bore portion 22. An additional atmospheric passage 80 is provided communicating with the bore 22 and bore 72 of the valve 70. A passage 82 is provided communicating with bore portion 24 and bore 72 and is adapted to transmit fuel from port 16 to valve 70 as will be explained later. The valve body 12 in the area of valve 70 extends into an intake manifold space 83 of an internal combustion engine.

Figure 2:
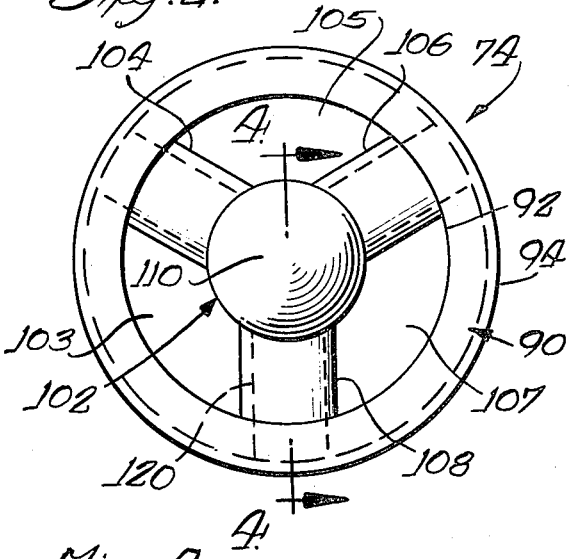
FIG. 2 is a top view of the fuel dividing element of FIG. 1.
Figure 3:
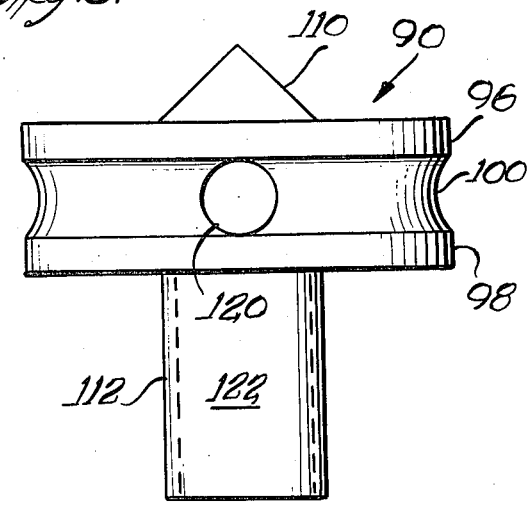
FIG. 3 is a plan view of the element of FIG. 2.
Figure 4:
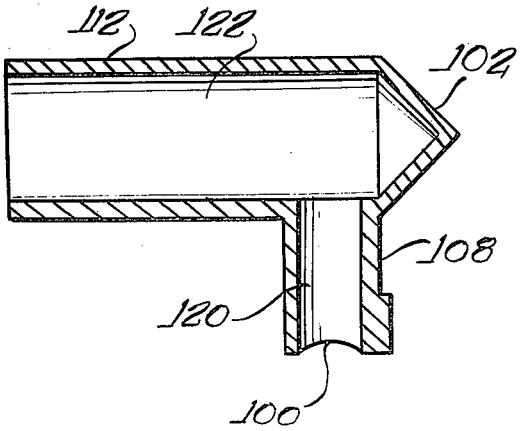
FIG. 4 is a sectional view taken along the lines 4—4 of FIG. 2.

The divider valve member 74, as illustrated in FIGS. 2, 3 and 4, comprises a wheel shaped structure having an annular portion 90 having an internal diameter 92 and external diameter 94. The external diameter 94 has two lands 96 and 98 separated by a groove or recessed portion 100. The annular portion 90 is connected to a central tubular member 102 by at least three spokes 104, 106 and 108. It should be noted that three spokes are used only by way of example and that any number of spokes may be used by means of which sufficient flow rates of air and fuel are possible. The spokes 104, 106 and 108 together with annular member 90, define fuel apertures 103, 105 and 107. The central member 102 includes a conical surface 110 extending upwardly, as viewed in FIG. 3, from annular member 90. The central member 102 also includes a downwardly extending tubular portion 112. The member 102 is hollow having an interior space 122.

As viewed in FIG. 4, the spokes 104, 106 and 108 have an air passage 120 therethrough which connects the circumferential groove 100 with interior space 122 of member 102. It will be apparent that additional spokes can be provided as would be necessary to carry increased amounts of air or other fluid. The space 122 at the lower end of tubular portion 112 is the exit or emitting port for air flowing through the divider valve 74.

The unique injection valve mechanism of the present invention operates as follows. A control signal pressure is received in port 36. This may be, for example, a pulsing pressure which is the result of a fluidic control system or could be a pulsating air pressure produced by any known means, or could be a pulsating liquid pressure produced by known means. The frequency and duration of pulses as will be seen, will vary the amount of fuel emitted from the valve 70 to port 19. Fuel is received in port 16 and will flow through orifice passage 60. When the control pressure in port 36 pulses, diaphragm 34 will flex moving spool 40 to the right to open passage 78 to passage 80 to admit atmosphere from port 18 into the recess 100 and thus to the central portion 122 of the divider valve 74. At the same time valve spool 40 will contact ball 50 and move same from valve seat 52 admitting fuel into passage 82, chamber 72 and through apertures 103, 105 and 107 to the area surrounding the lower end of portion 112.

Thus, it will be seen that a fuel flow path is provided from port 16, through valve 50, 52, into chamber 72, and through apertures 103, 105 and 107 to fuel outlet port 19. Conical surface 110 is disposed centrally of the fuel path upstream of port 19.

The fuel will be divided and dispersed as it meets conical surface 110 and be distributed equally around tubular member 112 and will in effect be given a turbulent motion. As the fuel passes the outlet of tubular portion 112 it will be mixed with the air emitting centrally thereof from space 122. Since the fuel and the air are opening into the intake manifold area of an engine, the air will expand rapidly at this point and tear the fuel into very fine particles as compared to normal fuel injection devices. This mixture of air and fine fuel particles will then flow into the combustion cylinders of an engine through the intake manifold.

When the pressure pulse is interrupted the flexible diaphragm 34 will return to its normal position allowing the valve 50 to seat and cutting off the supply of fuel and in addition closing the connection between passages 78 and 80 admitting atmospheric pressure to the valve 70. Since the air port 18 is closed to the valve 70 at this time, any bleed of manifold vacuum pressure is kept to a minimum.

The unique valve as thus described above, serves to provide a finely dispersed fuel and air mixture, in a simple manner due to the unique cone design for spreading and swirling the fuel around the outlet of a central air passage. The radial arms or spokes 104, 106 and 108 together can carry large amounts of air because of their additive volume connecting to the large central space 122. The unique valve 10 of the present invention thus provides a simple and efficient mechanism for providing an air and finely dispersed fuel mixture which is adaptable to fine control of the amount of fuel being admitted by merely changing the frequency and/or duration of pressure pulses at port 36. As is apparent, even mechanical means can be utilized to move or pulse the diaphragm 34 to control the fuel-air injection mechanism 10. In addition, it will be readily apparent that various sizes and shapes of divider valves 70 can be utilized to provide for varying engine conditions and to tailor the valve to function with a specific engine.

In addition, the unique valve of the present invention utilizes the valve spool 40 to close off atmosphere port 18 when no fuel is to be injected to prevent the possibility of continuous air bleed into the intake manifold.

Various features of the invention have been particularly shown and described. However, it should be obvious to one skilled in the art that modifications may be made therein without departing from the scope of the invention.

I claim:

1. A fuel metering device for providing a controlled flow of fuel from a fuel outlet port comprising a body portion, fuel valve means and a fuel chamber in said body portion, said fuel valve adapted to intermittently admit fuel to said fuel chamber, said fuel chamber partly defining a fuel flow path to said fuel port, a fuel dispersing element in said chamber having a dividing portion disposed in said fuel path on the upstream side of said fuel port, said element including internal air passage means extending therethrough, and said air passage means emitting air in said fuel port centrally of said fuel flow path at said fuel port.

2. A fuel metering device as claimed in claim 1 wherein said dividing portion comprises a conical surface.

3. A fuel metering device as claimed in claim 1 wherein said body portion has an air passage connected to said element to supply air thereto, said fuel valve means adapted to open said air passage when fuel is being admitted to said fuel chamber.

4. A distributing and dividing element adapted for use in a fuel metering mechanism; said element constructed to be placed in a chamber in a fuel path; said element having an outer annular hollow section, a conical surface disposed in said fuel path, a central hollow tubular portion extending in the direction of the fuel path, and a series of hollow radial spokes connecting said annular section and said tubular portion; the annular surface adapted to closely fit the interior wall of said chamber; means in said wall supplying air to the interior of said annular section and thereby to said tubular portion whereby said conical surface will disperse the fuel flowing in said path into fine particles which are mixed with the air being admitted through said tubular portion whereby a proper mixture is produced for supply to combustion chambers of an internal combustion engine.

* * * * *